US009943855B2

(12) United States Patent
Boehlefeld

(10) Patent No.: US 9,943,855 B2
(45) Date of Patent: Apr. 17, 2018

(54) CRUSHING MACHINE CONSTRUCTION KIT FOR THE CONSTRUCTION OF A CRUSHING MACHINE, METHOD FOR CONVERTING A ROTARY SHEAR, AND A METHOD FOR CONVERTING A ROTARY SHREDDER

(71) Applicant: ERDMANN GMBH & CO. KG, Menden (DE)

(72) Inventor: Michael Boehlefeld, Arnsberg (DE)

(73) Assignee: Erdmann GmbH & Co. KG, Menden (DE)

( * ) Notice: Subject to any disclaimer, the term of this patent is extended or adjusted under 35 U.S.C. 154(b) by 657 days.

(21) Appl. No.: 14/534,404

(22) Filed: Nov. 6, 2014

(65) Prior Publication Data

US 2015/0122927 A1 May 7, 2015

(30) Foreign Application Priority Data

Nov. 6, 2013 (DE) ..... 10 2013 112 224

(51) Int. Cl.

| | |
|---|---|
| ***B02C 18/00*** | (2006.01) |
| ***B02C 18/14*** | (2006.01) |
| ***B02C 18/16*** | (2006.01) |
| ***B02C 18/18*** | (2006.01) |
| *B02C 15/00* | (2006.01) |

(52) U.S. Cl.

CPC ..... *B02C 18/142* (2013.01); *B02C 18/16* (2013.01); *B02C 18/182* (2013.01); *B02C 15/00* (2013.01); *B02C 2018/162* (2013.01); *Y10T 29/49716* (2015.01)

(58) Field of Classification Search

CPC ..... B02C 18/00; B02C 18/14; B02C 18/142; B02C 18/18; B02C 18/182; B02C 2018/0069

USPC ..... 241/236, 101.01

See application file for complete search history.

(56) References Cited

U.S. PATENT DOCUMENTS

| | | | | |
|---|---|---|---|---|
| 5,788,169 | A * | 8/1998 | Koenig | B02C 18/142 241/236 |
| 6,024,312 | A | 2/2000 | Spiesshofer | |
| 6,092,753 | A * | 7/2000 | Koenig | B02C 18/142 241/236 |
| 6,394,376 | B1 * | 5/2002 | Koenig | B02C 18/142 241/230 |
| 6,616,077 | B2 * | 9/2003 | Koenig | B02C 18/142 241/230 |
| 9,101,938 | B2 | 8/2015 | Becker et al. | |

(Continued)

FOREIGN PATENT DOCUMENTS

| | | | |
|---|---|---|---|
| DE | 4423424 | A1 | 2/1996 |
| DE | 102011001878 | A1 | 10/2012 |
| EP | 2072138 | A1 | 6/2009 |

(Continued)

*Primary Examiner* — Faye Francis

(74) *Attorney, Agent, or Firm* — Laurence A. Greenberg; Werner H. Stemer; Ralph E. Locher

(57) ABSTRACT

A crushing machine construction kit for the construction of a crushing machine contains a drive device and a frame of a crushing device. The crushing machine construction kit further contains at least two shear shafts and at least two shredder shafts for the selective configuration of the crushing machine as a rotary shear or as a rotary shredder. A method converts the rotary shredder into the rotary shear.

9 Claims, 13 Drawing Sheets

(56) References Cited

U.S. PATENT DOCUMENTS

| | | | |
|---|---|---|---|
| 2015/0060583 | A1 | 3/2015 | Boehlefeld |

FOREIGN PATENT DOCUMENTS

| | | | |
|---|---|---|---|
| EP | 2394743 | A1 | 12/2011 |
| FR | 2785205 | A1 | 5/2000 |
| FR | 2955041 | A1 | 7/2011 |
| WO | 2013167497 | A2 | 11/2013 |

* cited by examiner

CRUSHING MACHINE CONSTRUCTION KIT FOR THE CONSTRUCTION OF A CRUSHING MACHINE, METHOD FOR CONVERTING A ROTARY SHEAR, AND A METHOD FOR CONVERTING A ROTARY SHREDDER

CROSS-REFERENCE TO RELATED APPLICATION

This application claims the priority, under 35 U.S.C. § 119, of German application DE 10 2013 112 224.8, filed Nov. 6, 2013; the prior application is herewith incorporated by reference in its entirety.

BACKGROUND OF THE INVENTION

Field of the Invention

The present invention relates to a crushing machine construction kit, a method for converting a rotary shear, and a method for converting a rotary shredder.

Crushing machines having at least two shear shafts are sufficiently known. They are used, for instance, to crush reusable materials, such as, for instance, sheathed copper cables, tires, etc., in order to feed them, for instance, to a further recycling process.

Crushing machines can be configured, in particular, as a rotary shear or rotary shredder. Both have preferred fields of application and differently configured shear shafts. Both are suited, however, substantially to the crushing of refuse, waste, scrap and reusable materials.

An embodiment of the crushing device as a rotary shear is characterized in comparison to the embodiment as a rotary shredder, with regard to the shear shafts or the shear disks, in particular in that the shear disks converge more closely together or with a greater distance apart, whereby different crushing mechanisms are obtained. In particular, as a result of the greater spacing of the blade edges in the embodiment as a rotary shredder, the reusable materials are substantially torn apart and less cut to pieces, as is the case with the rotary shear, in which the shear disks tend to converge with a lesser distance apart. In the rotary shredder version, the throughput, for process-related reasons, is generally higher than in the rotary shear version.

A rotary shear is preferably suited to the shredding of tires, cables, rubber mats, etc., while the rotary shredder is preferably suitable for domestic and industrial waste, for instance carpets, mattresses, sheeting, electronic scrap, etc.

In the final analysis, a crushing device must, however, be reserved for each field of application, whereby resources and space are ultimately wasted.

SUMMARY OF THE INVENTION

It is accordingly an object of the invention to provide a crushing machine construction kit for the construction of a crushing machine, a method for converting a rotary shear, and a method for converting a rotary shredder that overcome the above-mentioned disadvantages of the prior art devices and methods of this general type.

According to the invention, the object is achieved by a crushing machine construction kit for the construction of a crushing machine containing a drive device and a frame of a crushing device. The crushing machine construction kit further contains at least two shear shafts and at least two shredder shafts for the selective configuration of the crushing machine as a rotary shear or as a rotary shredder. The same frame can be equipped either with shear shafts or with shredder shafts, so that, according to requirement, a rotary shear or a rotary shredder can be provided as the crushing machine.

In an advantageous embodiment of the invention, it can be provided that a first end wall and a second end wall are equipped with bearing supports for the rotatable reception of, selectively, at least two shear shafts or at least two shredder shafts. Since the bearing supports are set up to receive both shaft types, the bearing supports per se can be retained and do not, for instance, have to altered or adapted to be able to receive both shaft types.

In a further advantageous embodiment of the invention, it can be provided that the crushing machine construction kit contains scrapers, wherein the crushing device, in a state of furnishment as a rotary shear, is equipped with the scrapers. With the scrapers in the crushing machine construction kit, the crushing device can be appropriately equipped with scrapers, which, in turn, can cooperate with the shear shafts.

In a further advantageous embodiment of the invention, it can be provided that the crushing machine construction kit contains compression blocks. The crushing device, in a state of furnishment as a rotary shredder, is equipped with the compression blocks. With the compression blocks in the crushing machine construction kit, the crushing device can be appropriately equipped with compression blocks, which, in turn, can cooperate with the shredder shafts. In the case of the rotary shear, the material is crushed between the shear disks. As a result of the large distance apart of the shredder blades, that is not possible in the case of the rotary shredder. The compression blocks serve in this case as a type of counter-stay or anvil, at which the transported material is broken up or torn apart upon the rotation of the shredder disks.

In a further advantageous embodiment of the invention, it can be provided that, in a furnishment as a rotary shear, scrapers are arranged along the first side wall and scrapers are arranged along the second side wall. The scrapers protrude perpendicularly from the side walls into the frame, wherein the scrapers project at least sectionally into the interspaces between the shear disks of the shear shafts. The clearance a between a shear disk of the first shear shaft and a nearest shear disk of the second shear shaft generally measures between 10 and 200 μm. The, at least in comparison to the rotary shredder, small distance between the shear disks and the scrapers helps to ensure that the shear disks primarily cut to pieces and do not tear apart the loaded material.

In a further advantageous embodiment of the invention, it can be provided that, in a furnishment as a rotary shredder, compression blocks are arranged along the first side wall and compression blocks are arranged along the second side wall. The compression blocks protrude perpendicularly from the side walls into the frame. The compression blocks project at least sectionally into the interspaces between the shredder disks of the shredder shafts, wherein the gap between the shredder disk and the nearest compression blocks generally measures between 1 and 200 mm. Nor are still larger spacings precluded in the case of larger machines. The, at least in comparison to the rotary shear, large distance between the shredder disks and the compression blocks helps to ensure that the shredder disks primarily tear apart and do not cut to pieces the loaded material.

In a further advantageous embodiment of the invention, it can be provided that the crushing machine construction kit contains compression block bridges. The crushing device, in a state of furnishment as a rotary shredder, is equipped with the compression block bridges. The compression block bridges respectively connect two opposite-situated compression blocks. In the case of the rotary shear, the material is crushed between the shear disks as a result of the large distance apart of the shredder blades, which is not possible in the case of the rotary shredder. The compression block bridges serve in this case as a type of counter-stay or anvil, at which the transported material is broken up or torn apart upon the rotation of the shredder disks.

A further object of the present invention lies in proposing a method for converting a rotary shear into a rotary shredder.

A further object of the present invention lies in proposing a method for converting a rotary shredder into a rotary shear.

Other features which are considered as characteristic for the invention are set forth in the appended claims.

Although the invention is illustrated and described herein as embodied in a crushing machine construction kit for the construction of a crushing machine, containing a drive device and a frame of a crushing device, a method for converting a rotary shear, and a method for converting a rotary shredder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 3A is a top plan view of the crushing device in a furnishment as the rotary shear;

FIG. 3B is a detail enlargement for better representation of a clearance a;

DETAILED DESCRIPTION OF THE INVENTION

Figure 1:
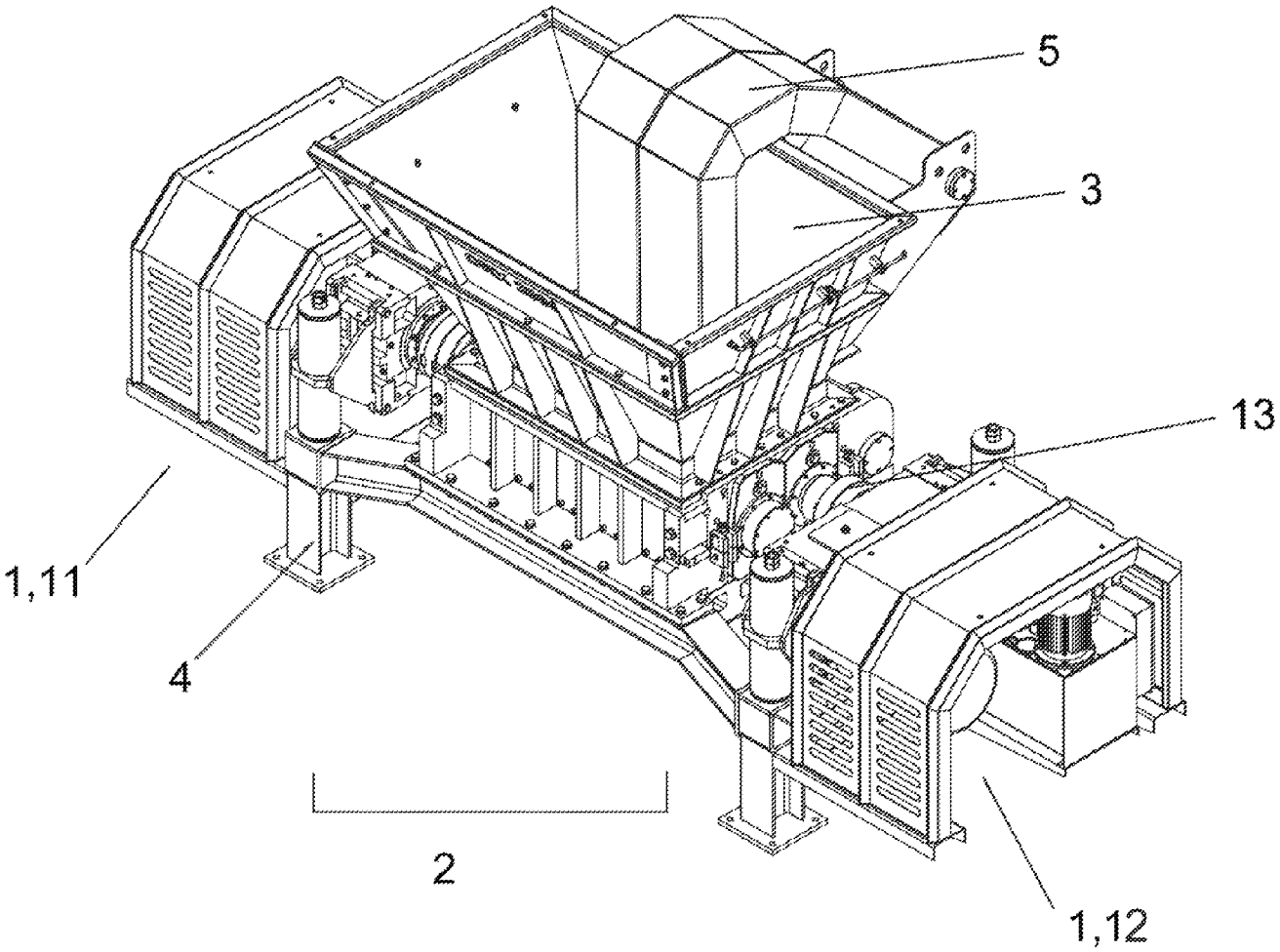
FIG. 1 is a diagrammatic, perspective view of a crushing machine.
Figure 2:
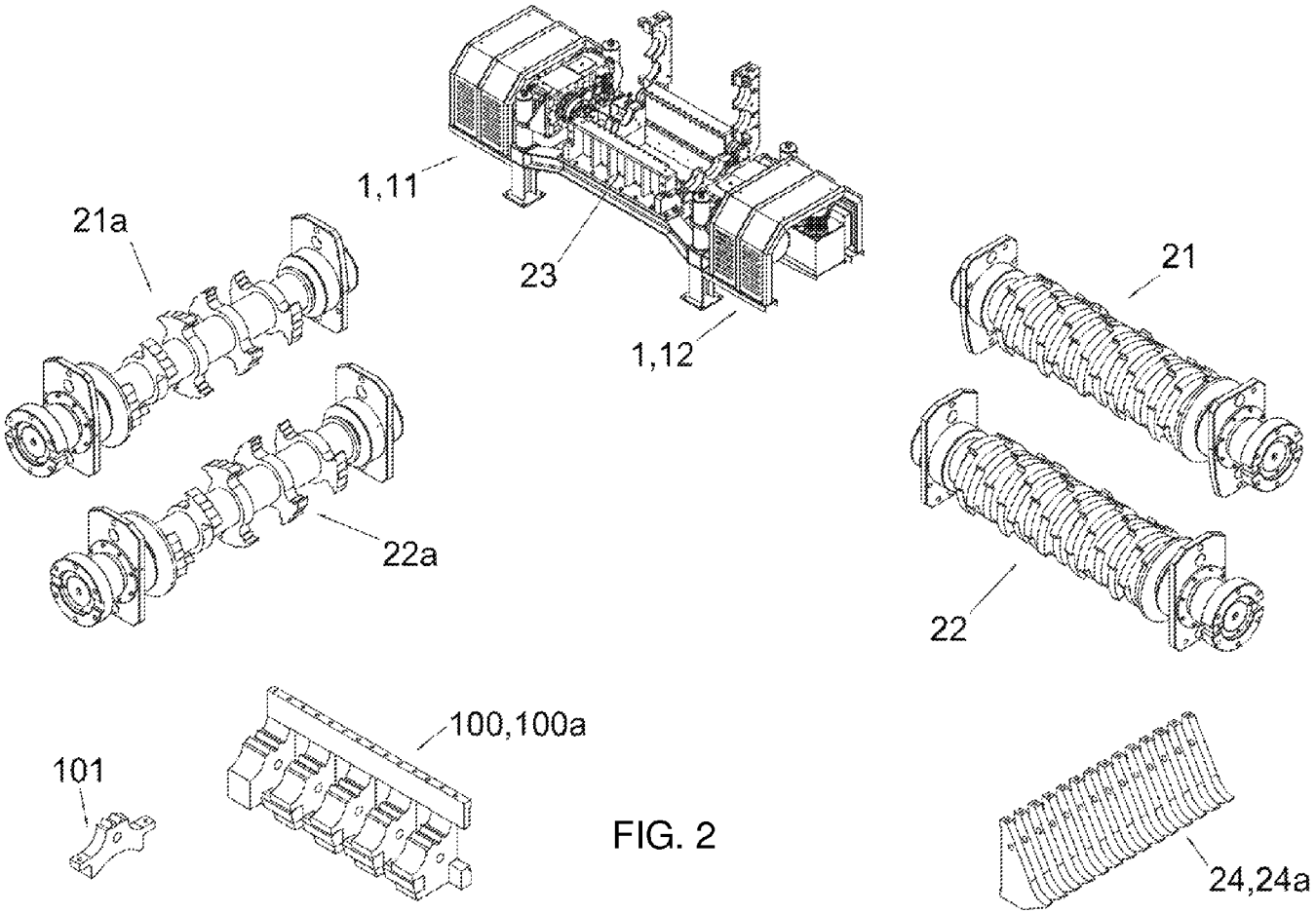
FIG. 2 is a diagrammatic, perspective view of a crushing machine construction kit according to the invention.

Referring now to the figures of the drawings in detail and first, particularly to FIGS. 1 and 2 thereof, there is shown a crushing machine construction kit according to the invention for the construction of a crushing machine substantially containing a drive device 1 and a frame 23 of a crushing device 2. In addition, the crushing machine construction kit according to the invention contains two shear shafts, in particular a first shear shaft 21 and a second shear shaft 22, as well as two shredder shafts, in particular a first shredder shaft 21*a* and a second shredder shaft 22*a*. The crushing machine construction kit can further contain scrapers 24, 24*a*, compression blocks 100, 100*a* and compression block bridges 101. The crushing machine can further contain a hopper 3, where appropriate with an after-pressing device 5. The drive device 1 and the crushing device 2 are preferably placed on a stand 4.

From the crushing machine construction kit, a crushing machine can be assembled. The crushing machine here contains, in particular, the drive device 1, the crushing device 2, the hopper 3, the stand 4 and the after-pressing device 5.

The drive device 1 substantially contains a first drive 11 and a second drive 12. The drives are of substantially structurally identical configuration, so that only one drive shall be described in greater detail below. The drives can comprise, for instance, an electric motor with downstream transmission. Preferably, an output per drive of more than 30 kW is provided. In a preferred embodiment, each drive has 95 kW.

Figure 3:
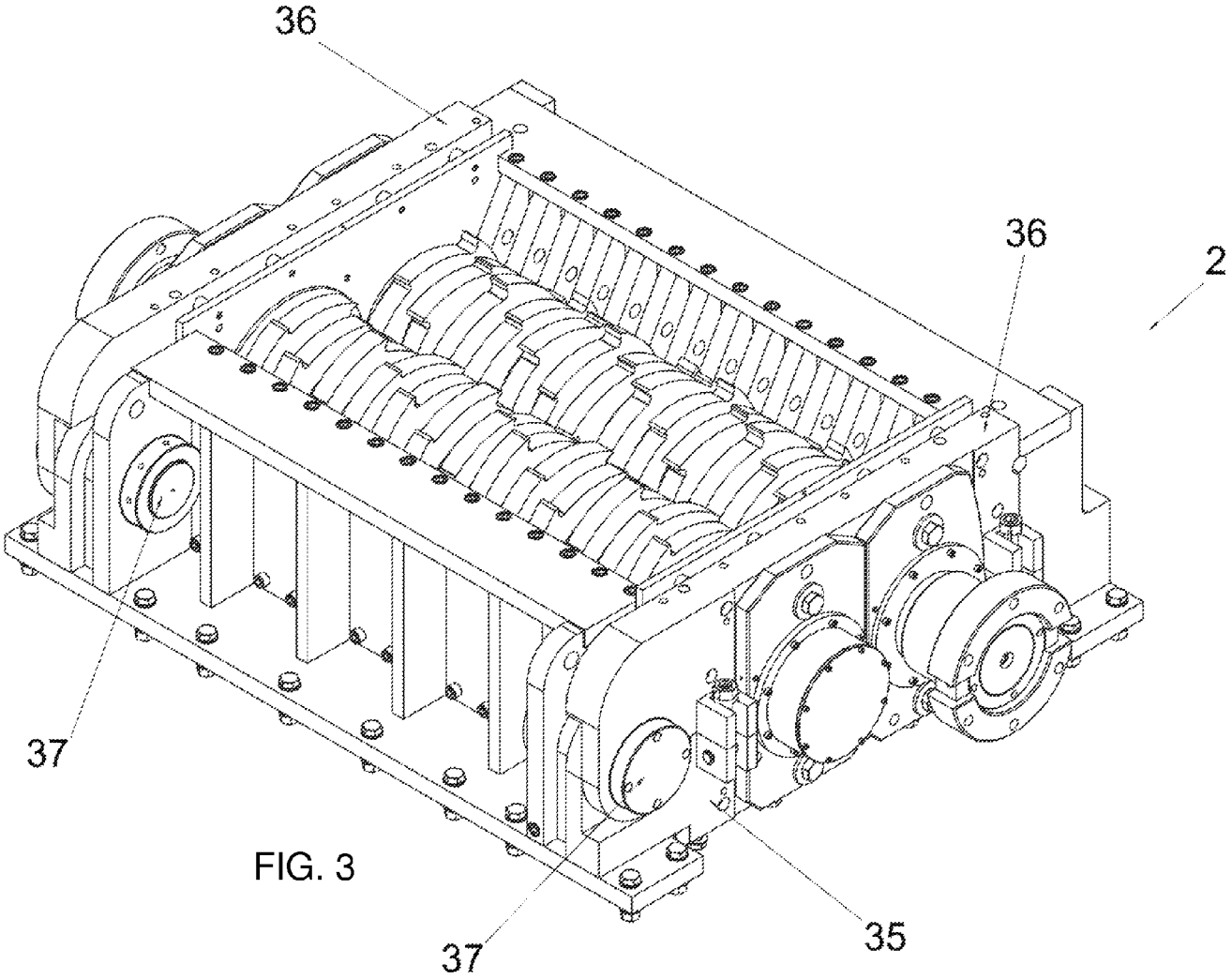
FIG. 3 is a diagrammatic, perspective view of a crushing device in a furnishment as a rotary shear.
Figures 3A, 3B:
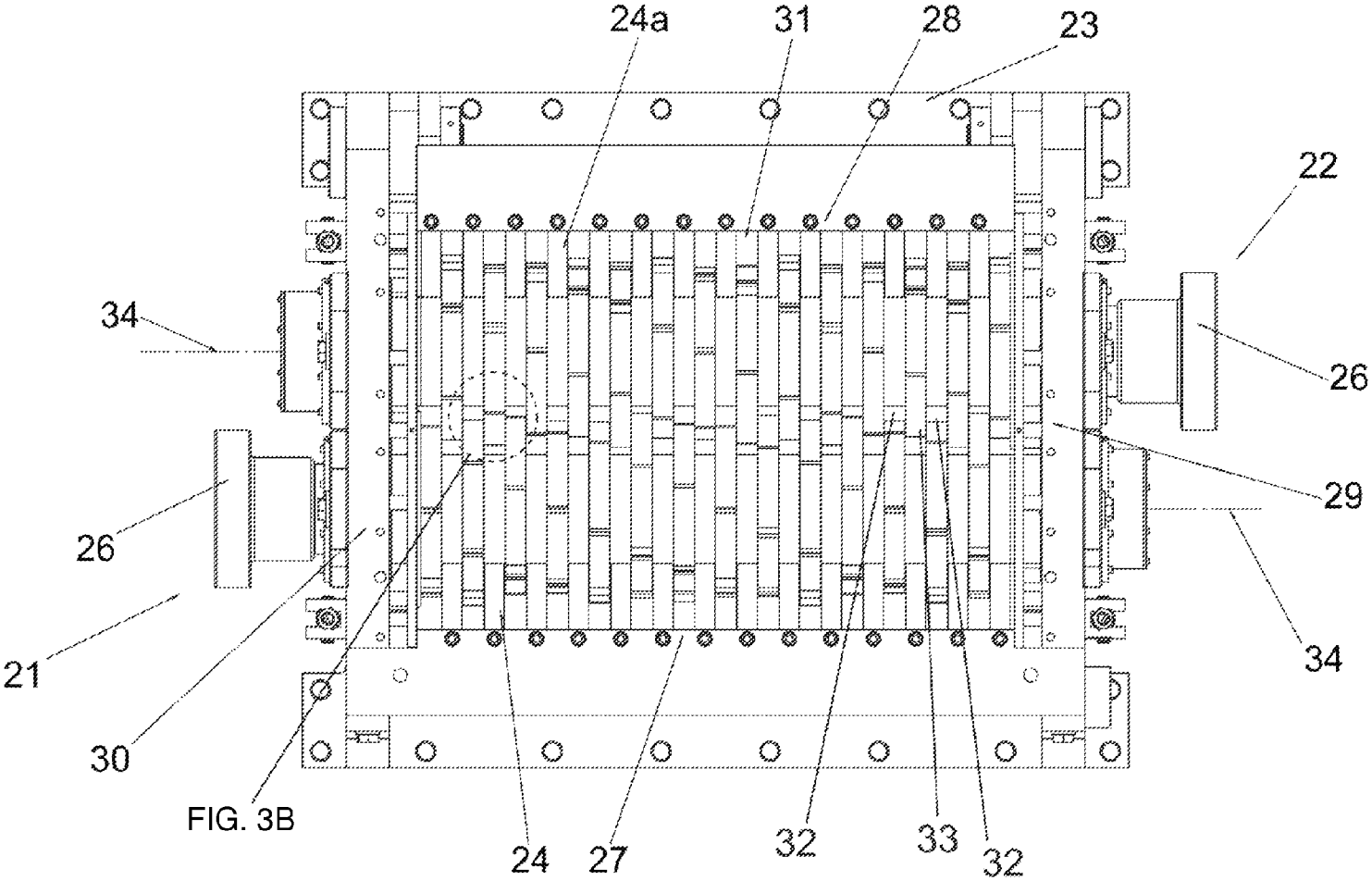
Figure 3B:
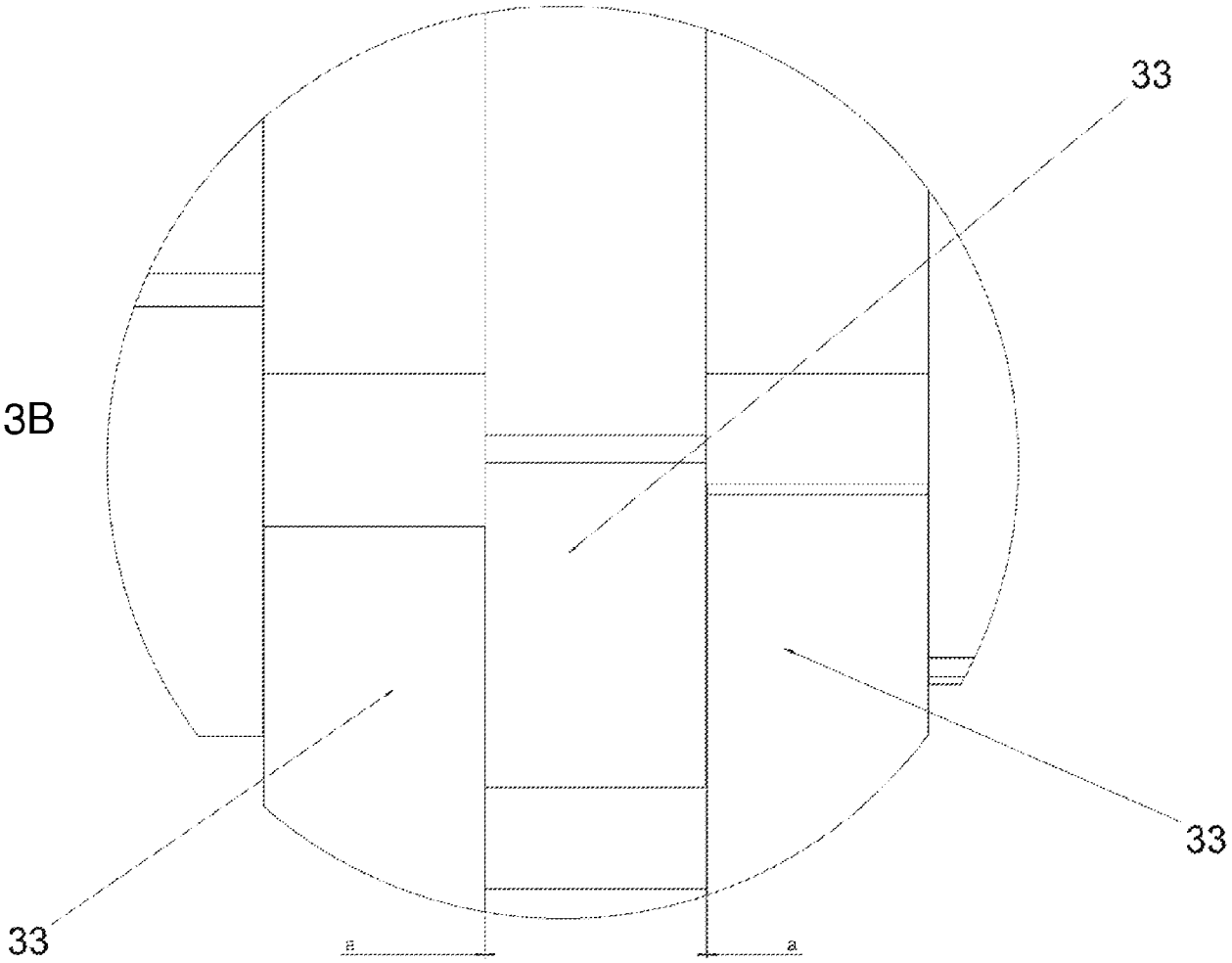

As shown in FIG. 3A, the frame 23 has substantially a first side wall 27, a second side wall 28, a first end wall 29 and a second end wall 30. The side walls 27, 28 and the end walls 29, 30 form in top view a rectangular frame.

In a standard usage setting or operating state, the hopper 3 is placed above the crushing device 2. The hopper 3 can also, however, be pivoted into a maintenance position or maintenance state.

According to the invention, it is provided that the crushing machine or the crushing device is usable either as a rotary shredder or a rotary shear, wherein a majority of the components of the crushing machine or of the crushing device can be retained and, in particular, the shear shafts must be exchanged for the shredder shafts, or vice versa.

Below, the state of the crushing machine or crushing device as a rotary shear is first examined.

Figure 7:
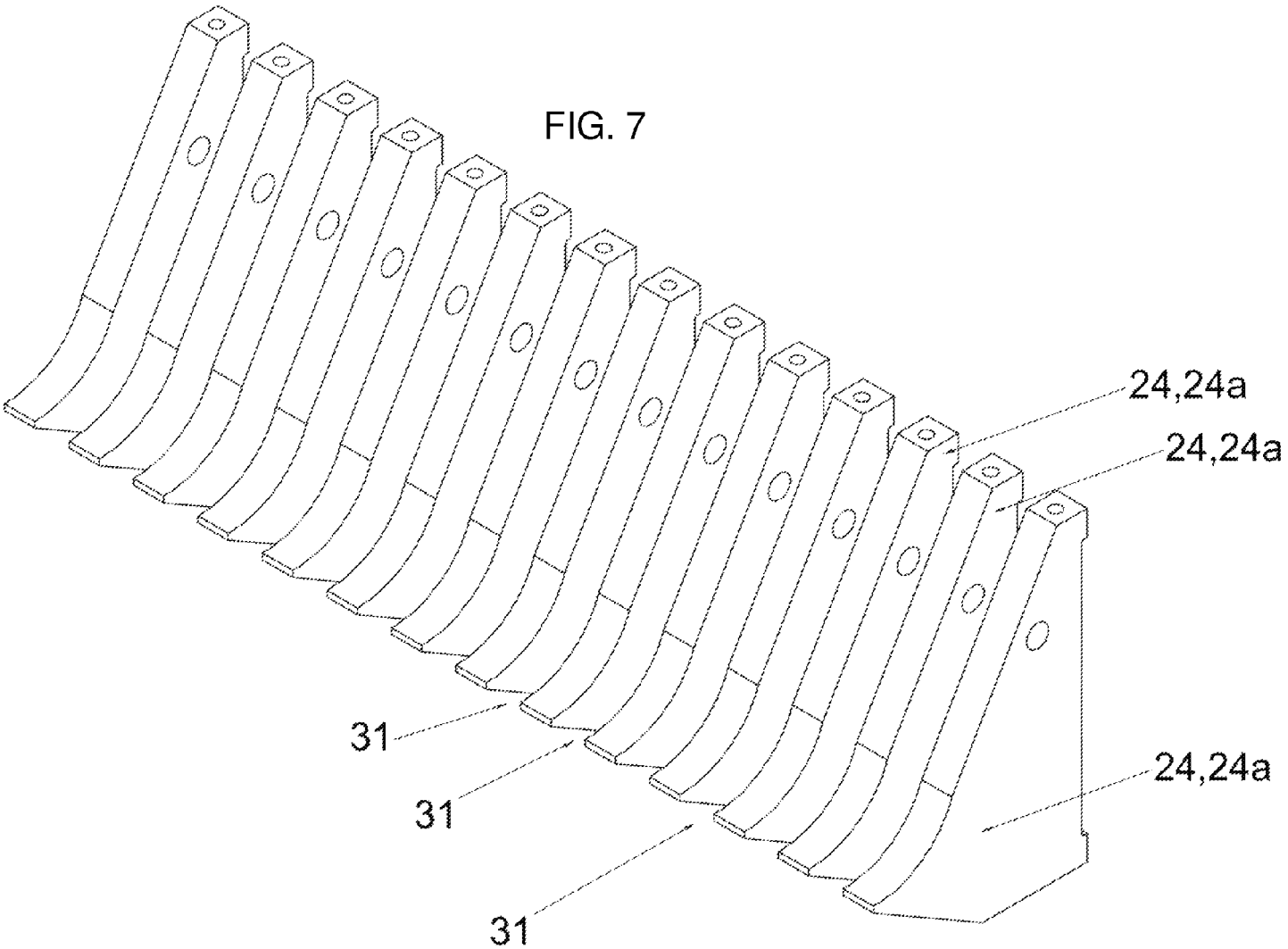
FIG. 7 is a diagrammatic, perspective view of scrapers for the furnishment as a rotary shear.

Along the first side wall 27 of the frame are placed scrapers 24, and along the second side wall 28 are placed scrapers 24*a*, which scrapers protrude perpendicularly from the side walls 27, 28 into the frame 23. The individual scrapers 24 or 24*a* of a side wall have a spacing between them in the longitudinal direction, so that distancing spaces 31 are formed between the scrapers 24 or 24*a* (see FIG. 7).

Figure 5:
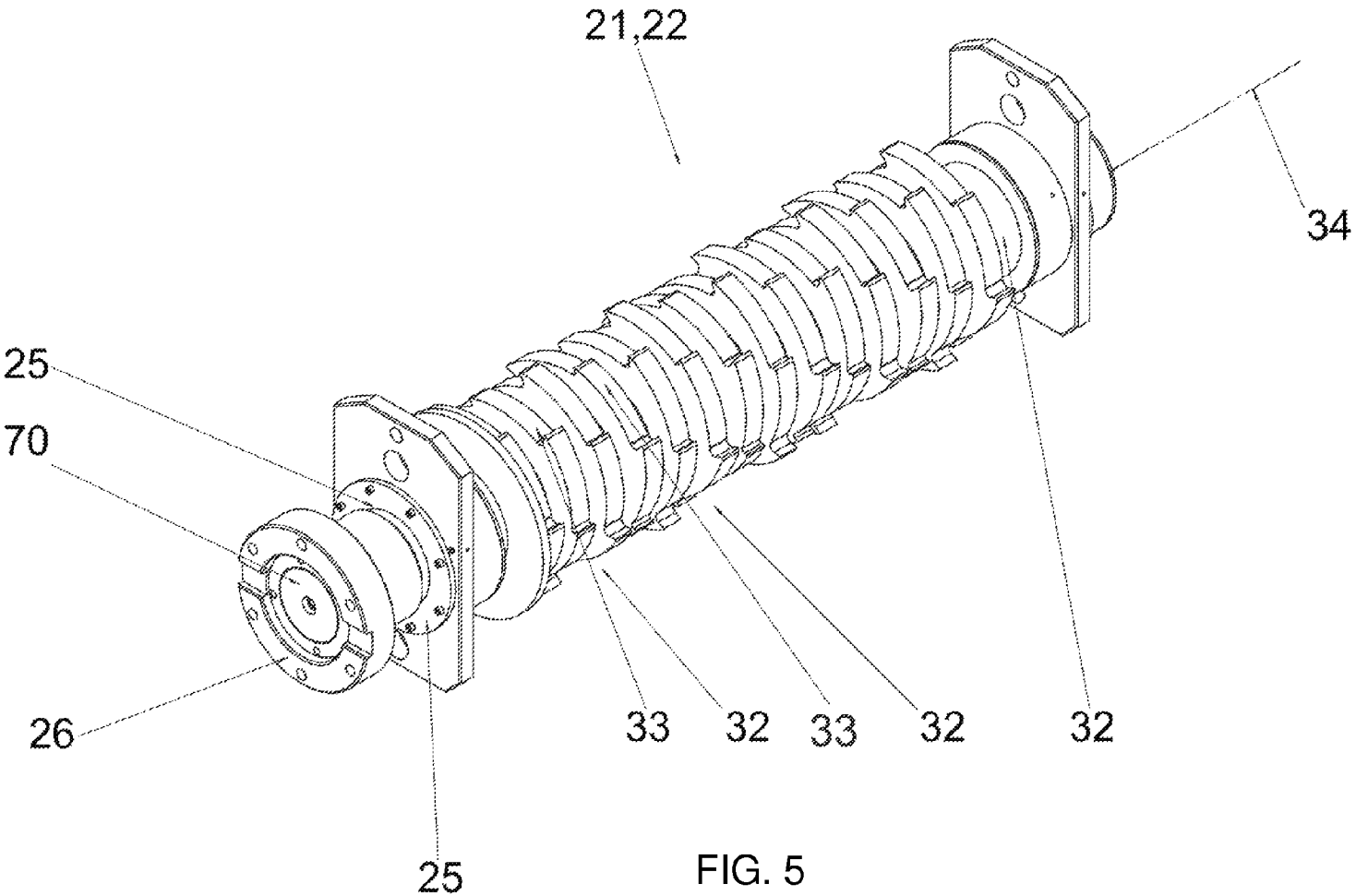
FIG. 5 is a diagrammatic, perspective view of a shear shaft.
Figure 6:
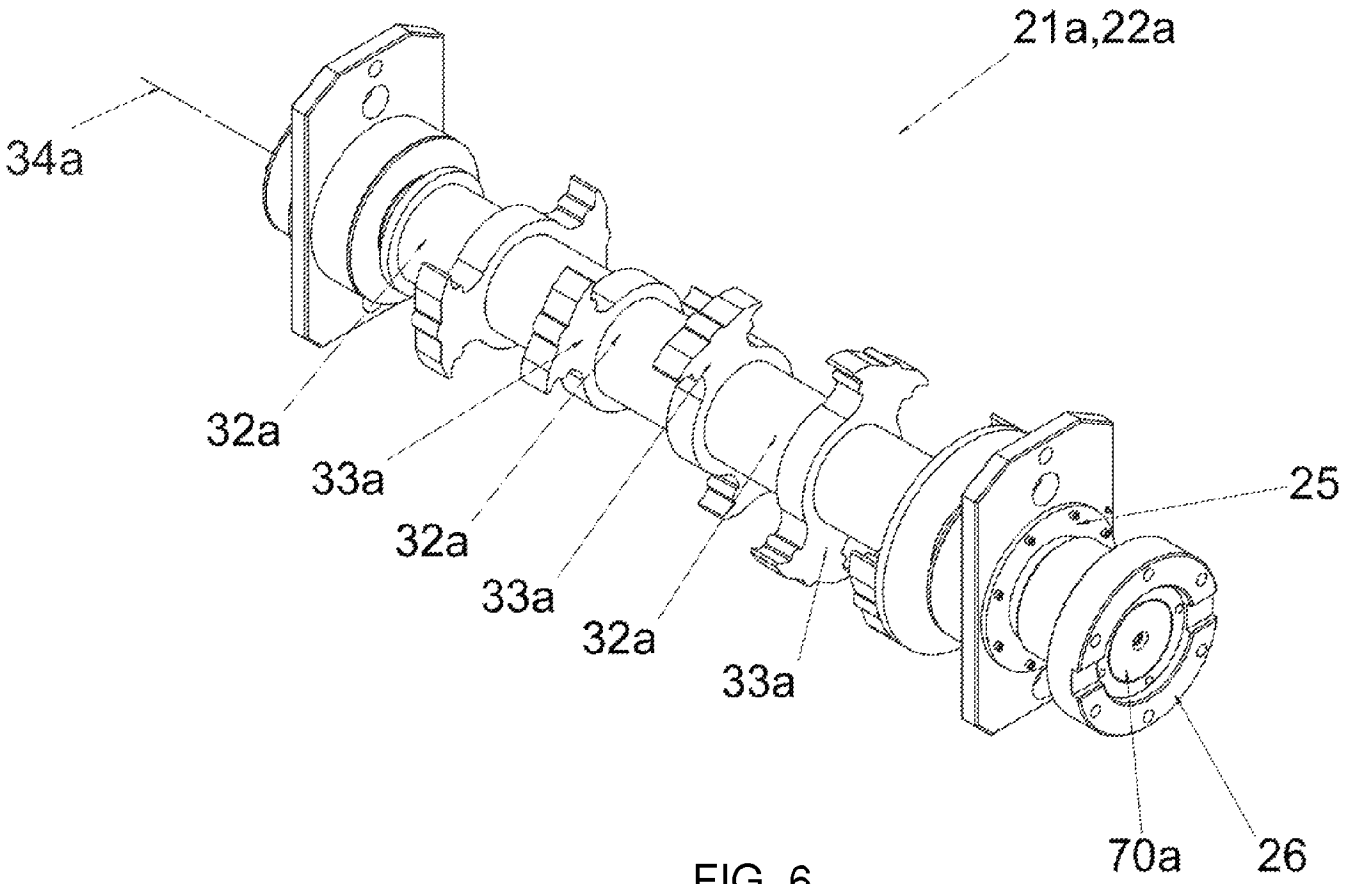
FIG. 6 is a diagrammatic, perspective view of a shredder shaft.

A shear shaft 21, 22 has substantially a shaft 70, a number of shear disks 33 and a number of distancing bushes 32 (see FIGS. 5 and 6). The shear disks 33 are substantially configured as elevations from the shaft, which elevations encircle the shaft and are provided on the periphery with draw-in hooks. Between the shear disks 33 are provided distancing bushes 32, which accordingly form distancing spaces between the shear disks 33. The shear shaft 21, 22 has a rotational axis 34. Related to the rotational axis 34, the shear disks 33 have a larger radius than the shaft 70 or the distancing bushes 32. The shear shaft 21, 22 can be of unipart configuration, that is to say made from one piece, but also of multipart configuration.

At least two shear shafts, that is to say a first shear shaft 21 and a second shear shaft 22, are rotatably accommodated in the crushing device, in particular in the frame 23. The shear shafts 21, 22 or the rotational axes 34 of the shear shafts here run parallel to the side walls 27, 28 of the frame. The first shear shaft 21 is here facing toward the first side wall 27, and the shear disks 33 of the first shear shaft 21 run through the distancing spaces 31 of the scrapers 24 of the first side wall 27 (see FIG. 3A). The second shear shaft 22 faces toward the second side wall 28, and the shear disks 33 of the second shear shaft 22 run through the distancing spaces 31 of the scrapers 24*a* of the second side wall 28. In addition, the shear disks 33 of the first shear shaft 21 run through the distancing spaces 32 of the second shear shaft 22, and the shear disks 33 of the second shear shaft 22 run through the distancing spaces 32 of the first shear shaft 21.

In a state of the crushing machine or crushing device as a rotary shredder, the crushing machine or crushing device has, instead of the shear shafts, shredder shafts 21*a* and 22*a*. In addition, instead of the scrapers 24, compression blocks 100 and 100*a* are provided. Compression block bridges 101, which in a state as a rotary shear are not provided, are also provided.

Figure 4:
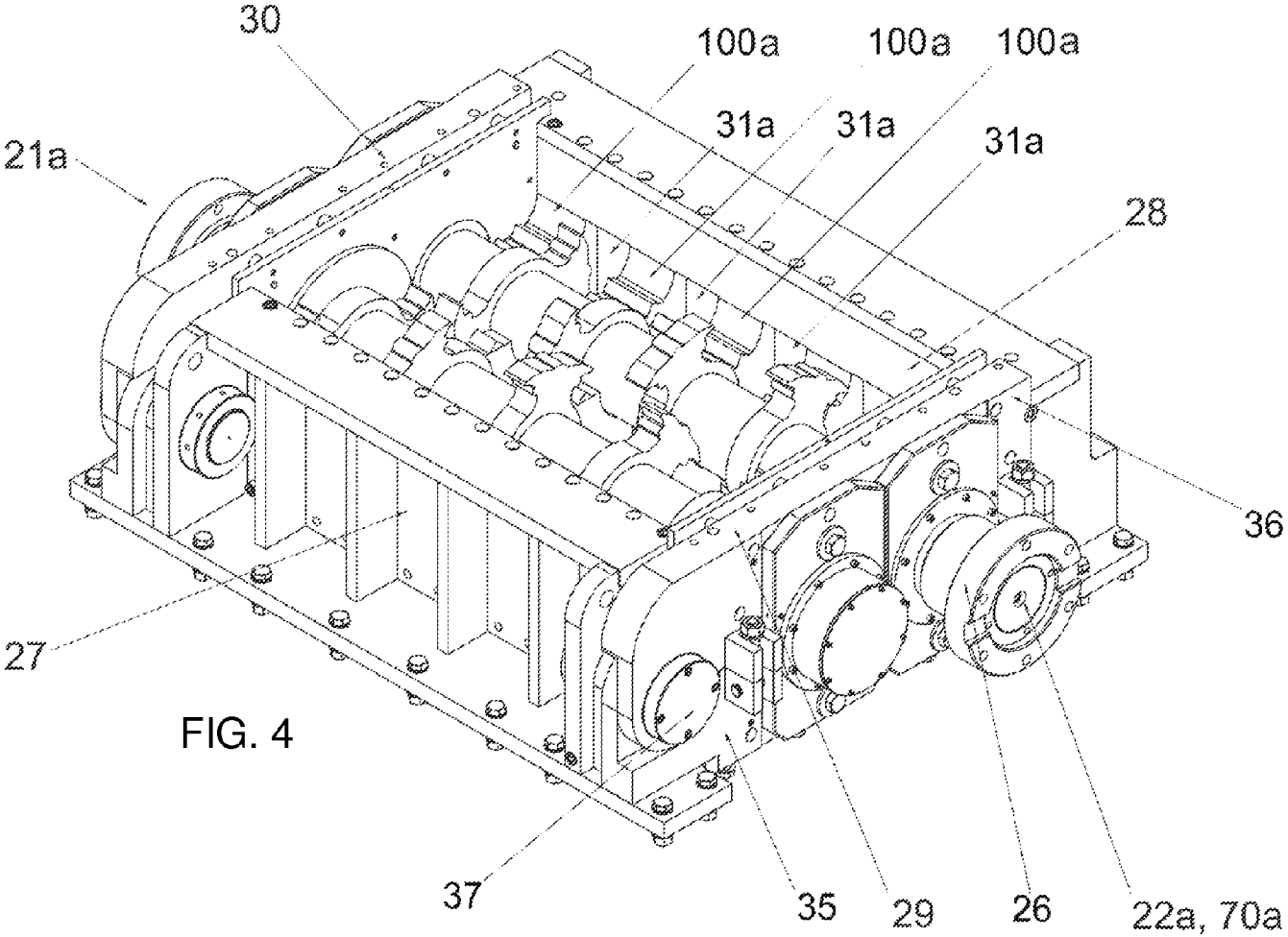
FIG. 4 is a diagrammatic, perspective view of the crushing device in a furnishment as a rotary shredder.
Figure 4A:
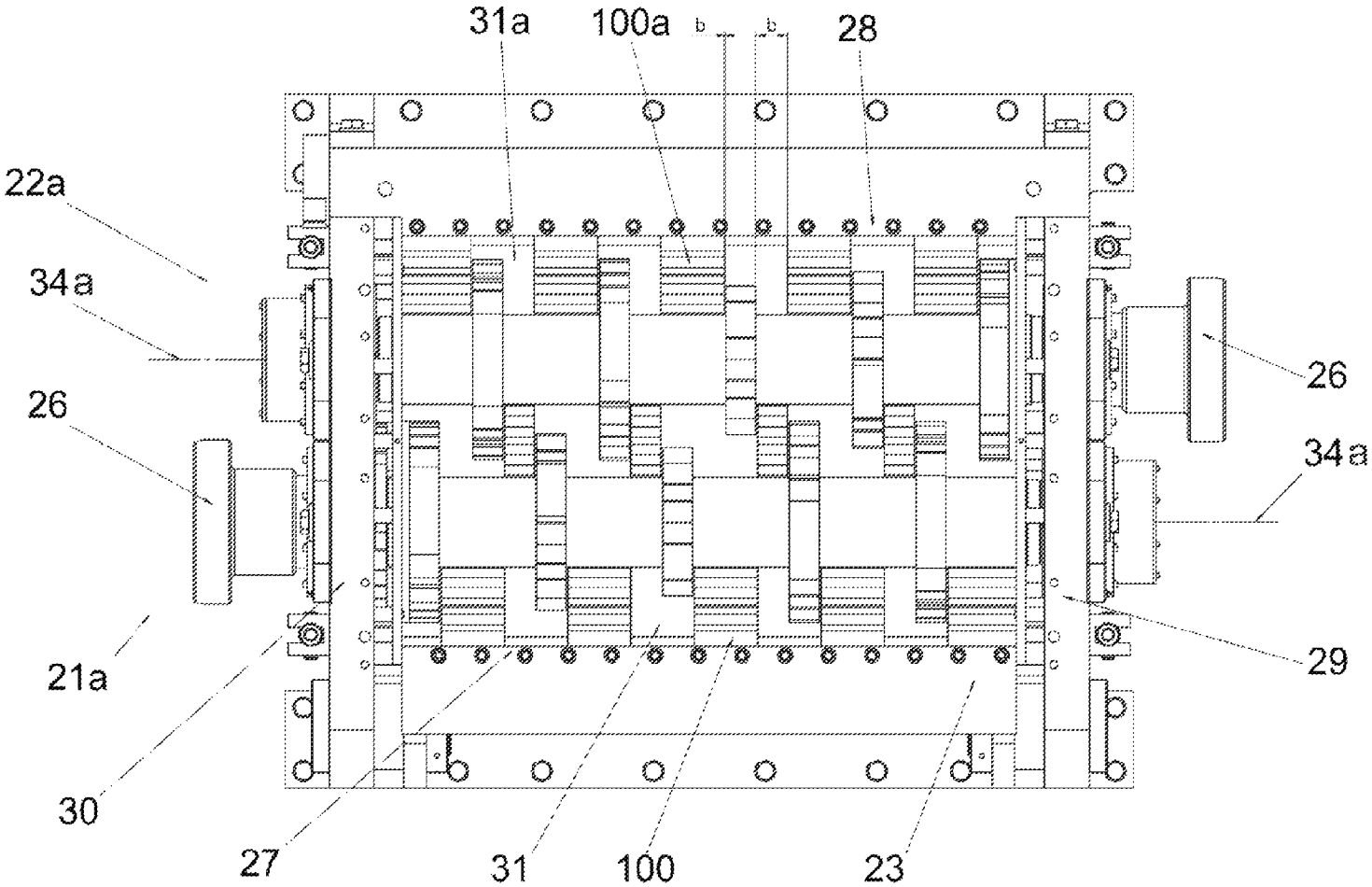
FIG. 4A is a top plan view of the crushing device in a furnishment as the rotary shredder.
Figure 9:
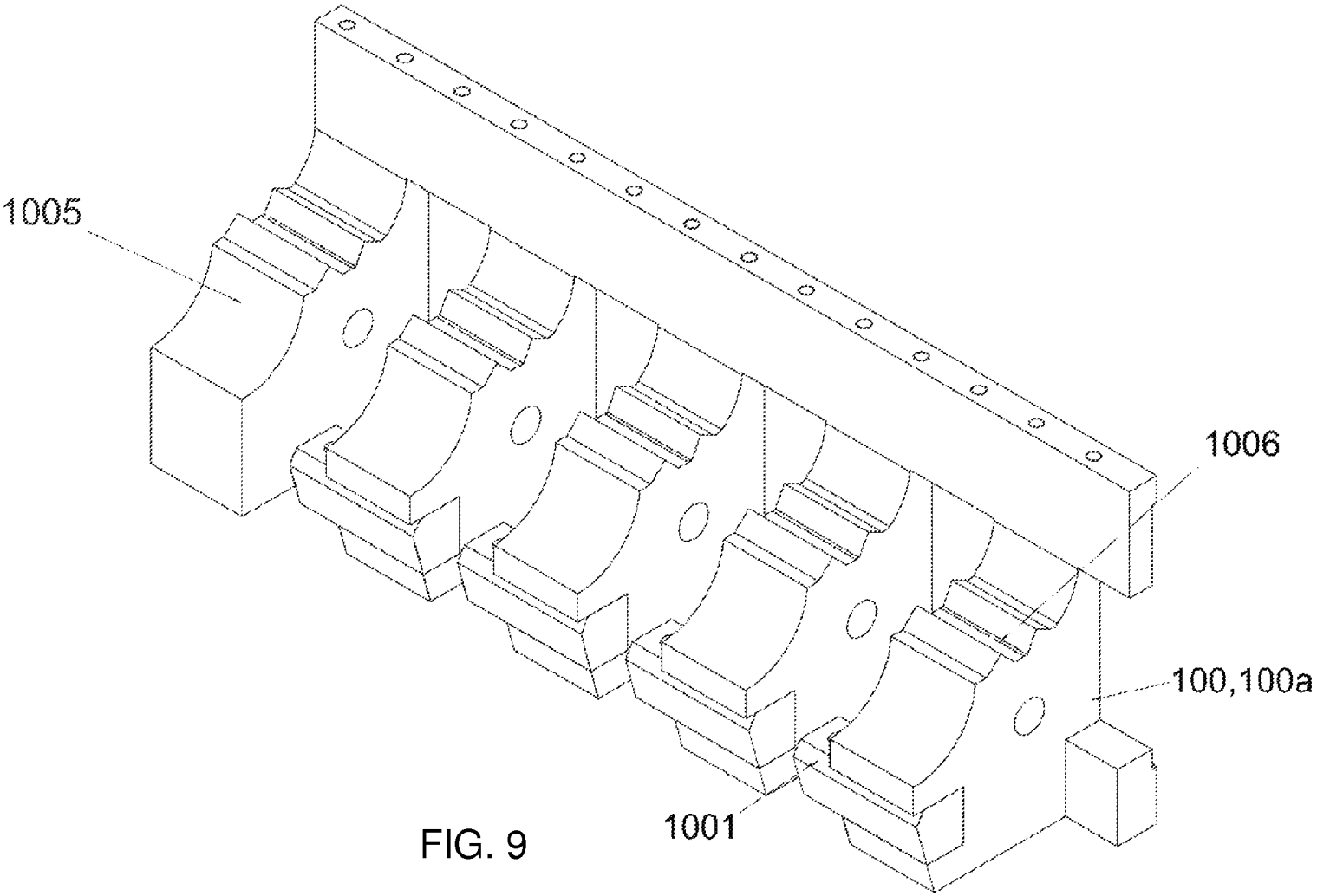
FIG. 9 is a diagrammatic, perspective view of compression blocks.

Along the first side wall 27 of the frame, compression blocks 100 and, along the second side wall 28, the compression blocks 100*a* are placed, which compression blocks protrude perpendicularly from the side walls 27, 28 into the frame 23 (see FIGS. 4 and 4A). The individual compression blocks 100 or 100*a* of a side wall have a spacing between them in the longitudinal direction, so that distancing spaces 31*a* are formed between the compression blocks 100 or 100*a*. The compression blocks 100 and 100*a*, or at least some of them, have a port 1001 for the compression block bridge 101 (see FIG. 9). The ports 1001 can be realized, for instance, as a borehole.

A shredder shaft 21*a*, 22*a* has substantially a shaft 70*a*, a number of shredder disks 33*a* and a number of distancing bushes 32*a*. The shredder disks 33*a* are substantially configured as elevations from the shaft, which elevations encircle the shaft and are provided on the periphery with draw-in hooks. Between the shredder disks 33*a* are provided distancing bushes 32*a*, which accordingly form distancing spaces between the shredder disks 33*a*. The shredder shaft 21*a*, 22*a* has a rotational axis 34*a*. Related to the rotational axis 34*a*, the shredder disks 33*a* have a larger radius than the shaft 70*a* or the distancing bushes 32*a*. The shredder shaft 21*a*, 22*a* can be of an unipart configuration, that is to say made from one piece, but also of multipart configuration.

At least two shredder shafts, that is to say a first shredder shaft 21*a* and a second shredder shaft 22*a*, are rotatably accommodated in the crushing device, in particular in the frame 23. The shredder shafts 21*a*, 22*a* or the rotational axes 34*a* of the shredder shafts here run parallel to the side walls 27, 28 of the frame. The first shredder shaft 21*a* is here facing toward the first side wall 27, and the shredder disks 33*a* of the first shredder shaft 21*a* run through the distancing spaces 31*a* of the compression blocks 100 of the first side wall 27. The second shredder shaft 22*a* is facing toward the second side wall 28, and the shredder disks 33*a* of the second shredder shaft 22*a* run through the distancing spaces 31*a* of the compression blocks 100*a* of the second side wall 28. In addition, the shredder disks 33*a* of the first shredder shaft 21*a* run through the distancing spaces 32*a* of the second shredder shaft 22*a*, and the shredder disks 33*a* of the second shredder shaft 22*a* run through the distancing spaces 32*a* of the first shredder shaft 21*a*.

Figure 8:
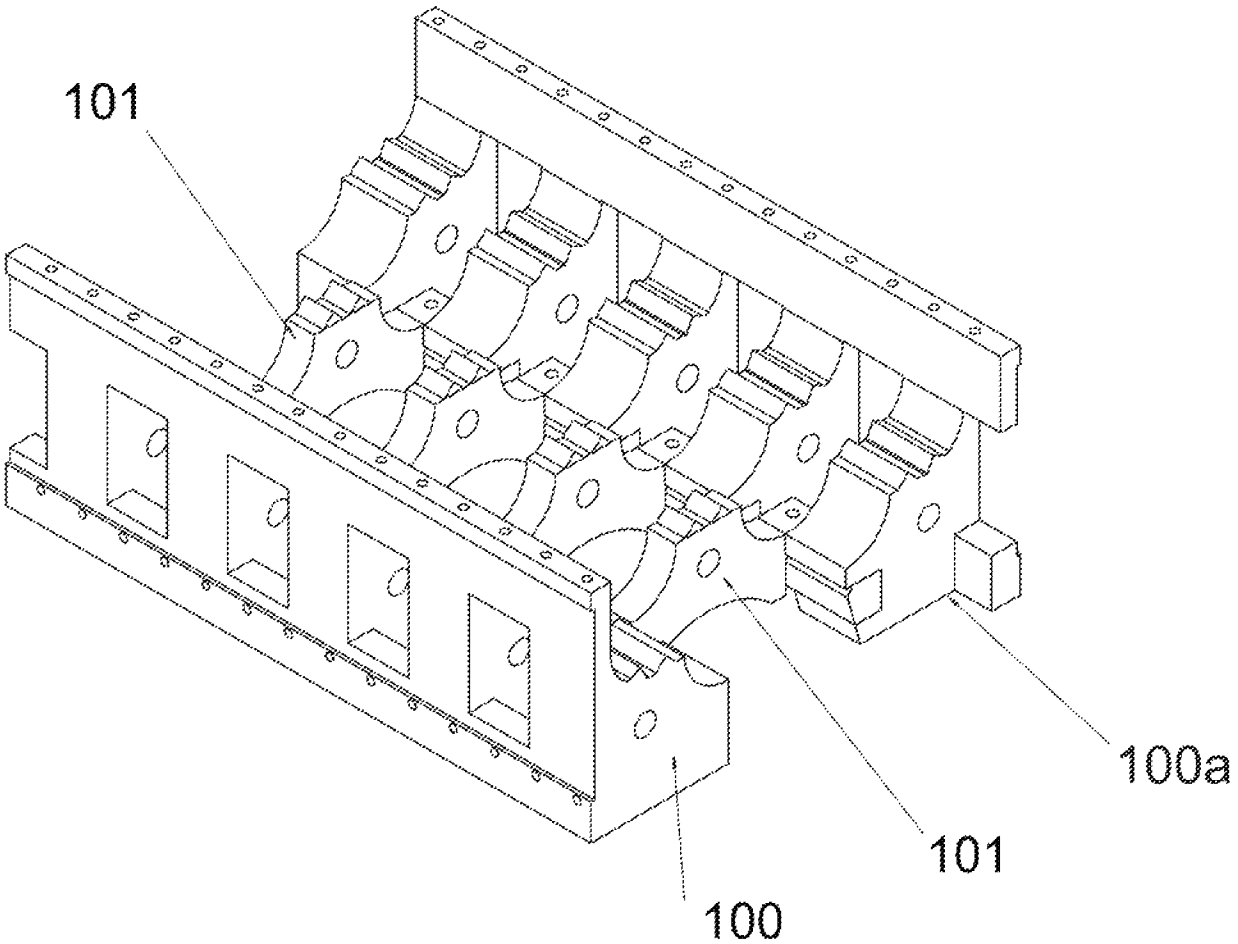
FIG. 8 is a diagrammatic, perspective view of a combination of compression blocks and compression block bridges for the furnishment as a rotary shredder.
Figure 10:
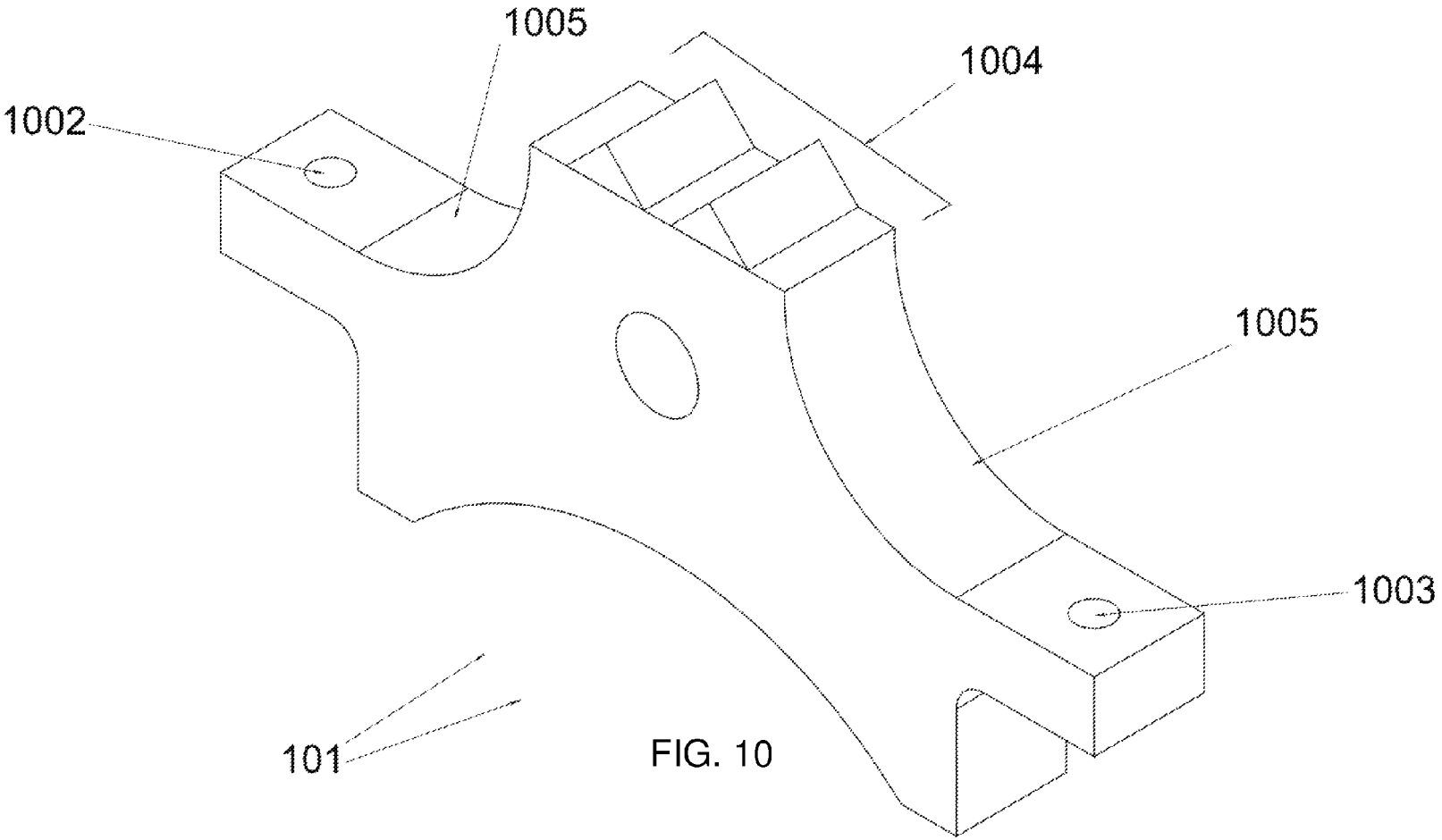
FIG. 10 is a diagrammatic, perspective view of a compression block bridge.

The compression block bridge 101 is substantially constituted by an elongate molding having a first port 1002 and a second port 1003, which are configured, for instance, as boreholes (see FIGS. 8 and 10). In addition, the compression block bridge is equipped with a compression zone 1004 and respectively two roughly quadrant-shaped recesses 1005. There are provided a plurality of compression block bridges 101, which are respectively disposed between a compression block 100 and a compression block 100*a*. To this end, for instance, the first port 1002 of the compression block bridge is connected to the port 1001 of a compression block 100, and the second port 1003 of the compression block bridge is connected to the port 1001 of an opposite compression block 100*a*. This can be realized, for instance, by screws, which are stuck through the boreholes. The compression blocks of one side, that is to say, for instance, the compression blocks 100, can be combined into one unit. The compression block can have a compression zone 1006. The compression zones 1004 and 1006 can be realized as two elevations of triangular cross section. The compression zones 1004 and 1006 serve substantially as barbs in the crushing process. The compression zones 1004 and 1006 serve substantially to compress and break up the crushing material upon the rotation of the shredder disks.

With regard to the already above-described arrangement of the shredder shafts or shear shafts in the frame, the shredder shafts or shear shafts are equipped with bearings 25. The bearings, in turn, are accommodated in bearing supports. The bearing supports are provided in the end walls 29, 30 or the bearing supports are formed by the end walls of the frame. Since the bearing supports are of substantially identical configuration, reference is made below substantially to one bearing support.

The shredder shafts or shear shafts 21 and 22 or 21*a* and 22*a* are in principle mounted by rolling bearings, for instance by ball bearings or roller bearings, in the frame 23 or the bearing supports. However, other bearing types, for instance slide bearings, can also enter into consideration. The bearings 25 are seated on the end of the shredder shafts or shear shafts 21 and 22 or 21*a* and 22*a*. Insofar as the bearing 25 has an outer race and an inner race, the inner race is connected to the shredder shaft or shear shaft 21 and 22 or 21*a* and 22*a*, and the outer race is connected to the frame 23 by the bearing support.

The bearing support substantially contains a basic element 35, a bearing support bridge 36, a pivot bearing 37 and releasable fixing device (see FIG. 3). The fixing device can be constituted, for instance, by a combination of a bracket and a threaded rod. Screw joints are also conceivable. The bearing support can also be quite differently constructed, for instance not in pivotable, but in plug-in form.

In the final analysis, a bearing support, which can be locked or unlocked relatively unproblematically via the releasable fixing device, is obtained. In an unlocked state, the bearing support bridge 36 can be swung open and, for instance, shear shafts 21, 22 accommodated in the frame 23 can be removed, together with bearings. After this, the shredder shafts 21*a*, 22*a*, for instance, can be inserted. For the exchange, the shafts can be appropriately separated from the drive device 1 or recoupled to the drive device. Rapid-change couplings 13, for instance, can here enter into consideration as the connection between drive device 1 or drives 11, 12 and the shafts.

In the course of this changeover, the scrapers 24, 24*a* can also be removed and replaced by compression blocks 100, 100*a*. In addition, compression block bridges 101 can be inserted between the compression blocks 100 and 100*a*.

After this, the bearing support bridge 36 can be reclosed and locked by the fixing device. The crushing device 2 can now be operated as a rotary shredder.

For a change from the rotary shredder to the rotary shear, the fixing device is likewise released and the bearing support bridges 36 are swung open. The shredder shafts 21*a*, 22*a* can be removed together with bearings 25. The compression blocks 100, 100*a* and compression block bridges 101 can also be removed. For the exchange, the shafts can be appropriately separated from the drive device 1 or recoupled to the drive device 1. Here the rapid-change couplings 13 can be used.

After this, the scrapers 24 and the shear shafts 21, 22 can be inserted. The bearing support bridge 36 can be relocked. The crushing device 2 can now be operated as a rotary shear.

The crushing device 2 substantially contains the frame 23, as well as, according to the application, shear shafts 21, 22 or shredder shafts 21*a*, 22*a*, and, according to the application, the scrapers 24 or the compression blocks 100 and compression block bridges 101. The function of the crushing device 2 is as follows. The first shear shaft 21 or first shredder shaft 21*a* is set in rotation by the first drive 11, and the second shear shaft 22 or the shredder shaft 22*a* by the second drive 12. Preferably, the first drive 11 is placed for this purpose on one side of the frame 23, and the second drive 12 on the other side of the frame 23. In the normal operating state, the rotational direction of the two shear shafts 21 and 22 or shredder shafts 21*a* and 22*a* is preferably controlled with respect to the center of the machine. The drive device can also be reversed, so that the shafts, for instance for the release of a stationary shaft, can be rotated the other way round.

Reusable materials or industrial and domestic waste, such as, for instance, sheathed copper cables, tires, electronic scrap, etc., can now be loaded into the hopper 3. In particular between the shear shafts 21, 22 or the scrapers 24, or between the shredder shafts 21*a*, 22*a* and the compression blocks 100, 100*a* or the compression block bridges 101, the reusable materials are crushed and partially split into their component parts by the crushing device. The crushed reusable materials fall out of the crushing device 2, for instance into a collecting vessel (not represented), which is set up under the crushing device 2 mounted for each stand 4.

The shredding proceeds substantially such that the material to be shredded is captured by two or more of the draw-in hooks and is drawn in the direction of the compression blocks. Since the compression blocks are fixed, the material is pressed so very much onto the compression blocks, that is to say compressed, until it tears. In contrast hereto, the material to be shredded is primarily cut into pieces in the case of the rotary shear.

In summary, a "hybrid crushing machine", which with few maneuvers can selectively be converted into a rotary shear or a rotary shredder, is proposed. In essence, only a small number of parts must here be exchanged, the frame 23 and the drive device 1, for instance, being able to be retained. Ultimately, with the crushing machine construction kit, a crushing machine as represented in FIG. 1 can be constructed—respectively as a rotary shear or as a shredder shear, according to choice.

With respect to the working principle, the rotary shear and the rotary shredder differ, in particular, as follows. An embodiment of the crushing device as a rotary shear is characterized in comparison to the embodiment as a rotary shredder, with regard to the shear disks or the shredder disks, in particular in that the shear disks converge more closely together or the shredder disks converge with a greater axial distance apart, whereby different crushing mechanisms are obtained. In particular, as a result of the greater axial spacing of the shredder disks in the embodiment as a rotary shredder, the reusable materials are substantially torn apart and less cut to pieces, as is the case with the rotary shear, in which the shear disks tend to converge with a lesser distance apart. In the rotary shredder version, the throughput, for process-related reasons, is generally higher than in the rotary shear version.

The clearance "a" between a shear disk 33 of the first shear shaft 21 and a shear disk 33 of the second shear shaft 22 measures, for instance, between 10 and 200 μm. The clearance "b" between a compression block 100 and a shredder disk 33*a* measures, for instance, between 1 and 200 mm. Nor are still larger spacings precluded in the case of large machines.

As a result of the crushing machine construction kit which is proposed here, the user can react individually to the crushing requirement and has here to reserve, in particular, only a frame 23 and a drive device 1. While the crushing machine or crushing device equipped as a rotary shear is preferably suited to the crushing of tires, cables, rubber mats, hemp, etc., the crushing machine or crushing device equipped as a rotary shredder can preferably be suitable for domestic and industrial waste, for instance carpets, mattresses, sheeting, electronic scrap, etc.

The following is a summary list of reference numerals and the corresponding structure used in the above description of the invention:

1 drive device
2 crushing device
3 hopper
4 stand
5 after-pressing device
11 first drive means
12 second drive means
13 rapid-change coupling
21 first shear shaft
21*a* first shredder shaft
22 second shear shaft
22*a* second shredder shaft
23 frame
24 scraper (of the first side wall)
24*a* scraper (of the second side wall)
25 bearing (of the shaft)
26 flange (of the shaft)
27 first side wall
28 second side wall
29 first end wall
30 second end wall
31 distancing space (of the scrapers)
31*a* distancing space (of the compression blocks)
32 distancing bush/distancing space (of the shear shaft)
32*a* distancing bush/distancing space (of the shredder shaft)
33 shear disk
33*a* shredder disk
34 rotational axis
34*a* rotational axis
35 basic element
36 bearing support bridge
37 bearing
70 shaft (of the shear shaft)
70*a* shaft (of the shredder shaft)
100 compression block
100*a* compression block
101 compression block bridge
1001 port (compression block)
1002 first port (compression block bridge)
1003 second port (compression block bridge)
1004 compression zone
1005 recesses
1006 compression zone

The invention claimed is:

1. A crushing machine construction kit for constructing a crushing machine, the crushing machine construction kit comprising:

a drive device;

a frame of a crushing device, said frame having at least a first side wall, a second side wall, a first end wall and a second end wall;

at least two shear shafts;

at least two shredder shafts;

said first end wall and said second end wall of said frame having bearing supports for a rotatable reception of, selectively, said at least two shear shafts or said at least two shredder shafts for a selective configuration of the crushing machine as a rotary shear or as a rotary shredder;

said bearing support having a basic element, a bearing support bridge, a pivot bearing and a releasable fixing device; and rapid-change couplings providing a connection between said drive device and said shafts.

2. The crushing machine construction kit according to claim 1, further comprising scrapers, wherein the crushing device, in a working mode as a rotary shear, is equipped with said scrapers.

3. The crushing machine construction kit according to claim 2, wherein each of said shear shafts has a shaft, a number of shear disks and a number of distancing bushes, said distancing bushes form distancing spaces between said shear disks.

4. The crushing machine construction kit according to claim 3, wherein in a working mode as the rotary shear, said scrapers are disposed along said first side wall and said scrapers are disposed along said second side wall, said scrapers protrude perpendicularly from said first and second side walls into said frame, said scrapers project at least sectionally into interspaces between said shear disks of said shear shafts including a first shear shaft and a second shear shaft, wherein a gap between said shear disk of said first shear shaft and said shear disk of said second shear shaft measures between 10 and 200 μm.

5. The crushing machine construction kit according to claim 1, further comprising compression blocks, wherein the crushing device, in a working mode as a rotary shredder, is equipped with said compression blocks.

6. The crushing machine construction kit according to claim 5, wherein each of said shredder shafts has a shaft, a number of shredder disks and a number of distancing bushes, said distancing bushes form distancing spaces between said shredder disks.

7. The crushing machine construction kit according to claim 6, wherein in the working mode as the rotary shredder, said compression blocks are disposed along said first side wall and said compression blocks are disposed along said second side wall, said compression blocks protrude perpendicularly from said first and second side walls into said frame, said compression blocks project at least sectionally into interspaces between said shredder disks of shredder shafts, wherein a gap between said shredder disk and said compression block measures between 1 and 200 mm.

8. The crushing machine construction kit according to claim 5, further comprising compression block bridges, wherein the crushing device, in a working mode as a rotary shredder, is equipped with said compression block bridges, said compression block bridges respectively connect two opposite-situated ones of said compression blocks.

9. The crushing machine construction kit according to claim 2, wherein said frame is a rectangularly shaped frame.

* * * * *